US006520616B1

(12) United States Patent
Parks et al.

(10) Patent No.: US 6,520,616 B1
(45) Date of Patent: Feb. 18, 2003

(54) PRINTER HAVING A CONTROLLER ADAPTED TO DISCOVER PRINT ENGINE STATUS OBJECTS AND METHOD

(75) Inventors: David D Parks, Vancouver, WA (US); Trung Vu Nguyen, Portland, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/964,166

(22) Filed: Sep. 26, 2001

(51) Int. Cl.[7] ..... B41J 29/393; B41J 2/05
(52) U.S. Cl. ..... 347/19; 347/59
(58) Field of Search ..... 347/19, 14, 23, 347/10, 16, 15, 20, 12, 59; 395/114, 112, 200

(56) References Cited

U.S. PATENT DOCUMENTS 5,550,957 A * 8/1996 Davidson, Jr. ..... 395/114
5,566,278 A * 10/1996 Patel et al. ..... 395/114
6,161,916 A * 2/2000 Gibson et al. ..... 347/19

* cited by examiner

*Primary Examiner*—Hai Pham
*Assistant Examiner*—Charles W. Stewart, Jr.

(57) ABSTRACT

A printer system for and corresponding method of determining an arrangement of status objects forming a status tree structure used to represent hardware components contained within a printer and the status tree structure stored within a print engine of the printer. A change in operational condition of one of the hardware components are detected with a sensor. A state of a status object corresponding to the one of the hardware components is changed to have an active state. A name of the status object having the changed state is transmitted from the print engine to a controller. The status object having the changed state is queried for a root path of the status object with the controller.

24 Claims, 3 Drawing Sheets

PRINTER HAVING A CONTROLLER ADAPTED TO DISCOVER PRINT ENGINE STATUS OBJECTS AND METHOD

TECHNICAL FIELD

The present invention generally relates to printers and, more particularly, to a printer having a controller adapted to discover print engine status objects and method.

BACKGROUND OF THE INVENTION

Printers, such as laser printers and ink jet printers, are used to image a pattern onto a print medium using, for example, toner or ink. Printers typically include a variety of hardware components for carrying out this task. Typically a printer will have a controller that is used to communicate with a print job source, such as a computer system. The print job source and the printer can be coupled directly to each other or through a network. The controller communicates print jobs received from the print job source to a print engine. The controller may reformat the print job, such as in the form of a raster image, before transmitting all or sequential portions of the print job to the print engine. The print engine is responsible for sending command signals to various hardware components of the printer to carry out the task of printing on the print medium.

Hardware components under the control of the print engine, include, for example, mechanisms to load, advance and eject the print medium, a cutter (when roll media is used as opposed to sheet media), a laser/toner assembly (for laser printers), a pen/ink cartridge assembly and associated carriage (for ink jet printers and plotters), paper trays, accessories (e.g., a stapler) and so forth.

Occasionally, printers experience a condition that reduces printer capabilities or renders the printer unable to print. Examples of such conditions include, for example, a pen that has malfunctioned, a pen that has run out of ink, a toner cartridge that is low on toner, a paper tray that is missing or is out of paper, a print media jam, etc. Often a sensor is used to detect these conditions. Upon detecting such a condition, the sensor transmits a signal to the print engine. The print engine communicates that the printer is in need of servicing to the controller. The controller, in turn, informs a user on a display local to the printer and/or by sending an appropriate signal to the print job source.

Each item of hardware in the printer and/or each sensor associated with an item of hardware (or, alternatively, groups of hardware or groups of sensors), is represented by a corresponding status object for use in logic executed by the printer or in internal printer signals. To provide as much information as possible to the user, the controller and print engine are designed to communicate meaningful information regarding hardware states by exchanging messages regarding the status objects. This means, however, that the print engine and the controller need to be fully compatible with each other and the controller needs to be preprogrammed with each of the printer's status objects. As a result, controllers and print engines cannot be designed independently of one another.

Accordingly, there exists a need in the art for a controller that can discover print engine status objects without preprogramming for use with a specific print engine.

SUMMARY OF THE INVENTION

According to one aspect of the invention, the invention is a method of determining an arrangement of status objects forming a status tree structure used to represent hardware components contained within a printer and the status tree structure stored within a print engine of the printer. The method includes detecting a change in operational condition of one of the hardware components with a sensor; changing a state of a status object corresponding to the one of the hardware components to have an active state; transmitting a name of the status object having the changed state from the print engine to a controller; and querying the status object having the changed state for a root path of the status object with the controller.

According to another aspect of the invention, the invention is a printer system. The printer system includes a controller that communicates with a print job source and receiving a print job from the print job source; a print engine that controls hardware components of a printer to place a desired image on a print medium in response to print data received from the controller; a status tree structure stored by the print engine and having an arrangement of status objects used to represent the hardware components of the printer; and a status tree discoverer adapted to determine an arrangement of the status objects by querying a status object having a name unrecognized by the controller for a root path of the status object, the query transmitted upon receipt of the name from the print engine, the name transmitted from the print engine to the controller when a state of the status object changes to an active state in response to a change in operational condition of the hardware component associated with the status object and thereby indicating an intervention state of the printer.

According to yet another aspect of the invention, the invention is a controller for a printer. The controller includes a means to receive a print job from a print job source and transmit corresponding print data to a print engine of a printer; and means to determine an arrangement of status objects forming a status tree structure used to represent hardware components contained within the printer and the status tree structure stored within the print engine, the determining means including: means to receive a name of an active status object from the print engine; and means to query the status object for a root path of the status object.

BRIEF DESCRIPTION OF THE SEVERAL VIEWS OF THE DRAWINGS

These and further features of the present invention will be apparent with reference to the following description and drawings. To illustrate the present invention in a clear and concise manner, the drawings may not necessarily be to scale and certain features may be shown in somewhat schematic form.

DETAILED DESCRIPTION OF THE INVENTION

Figure 1:
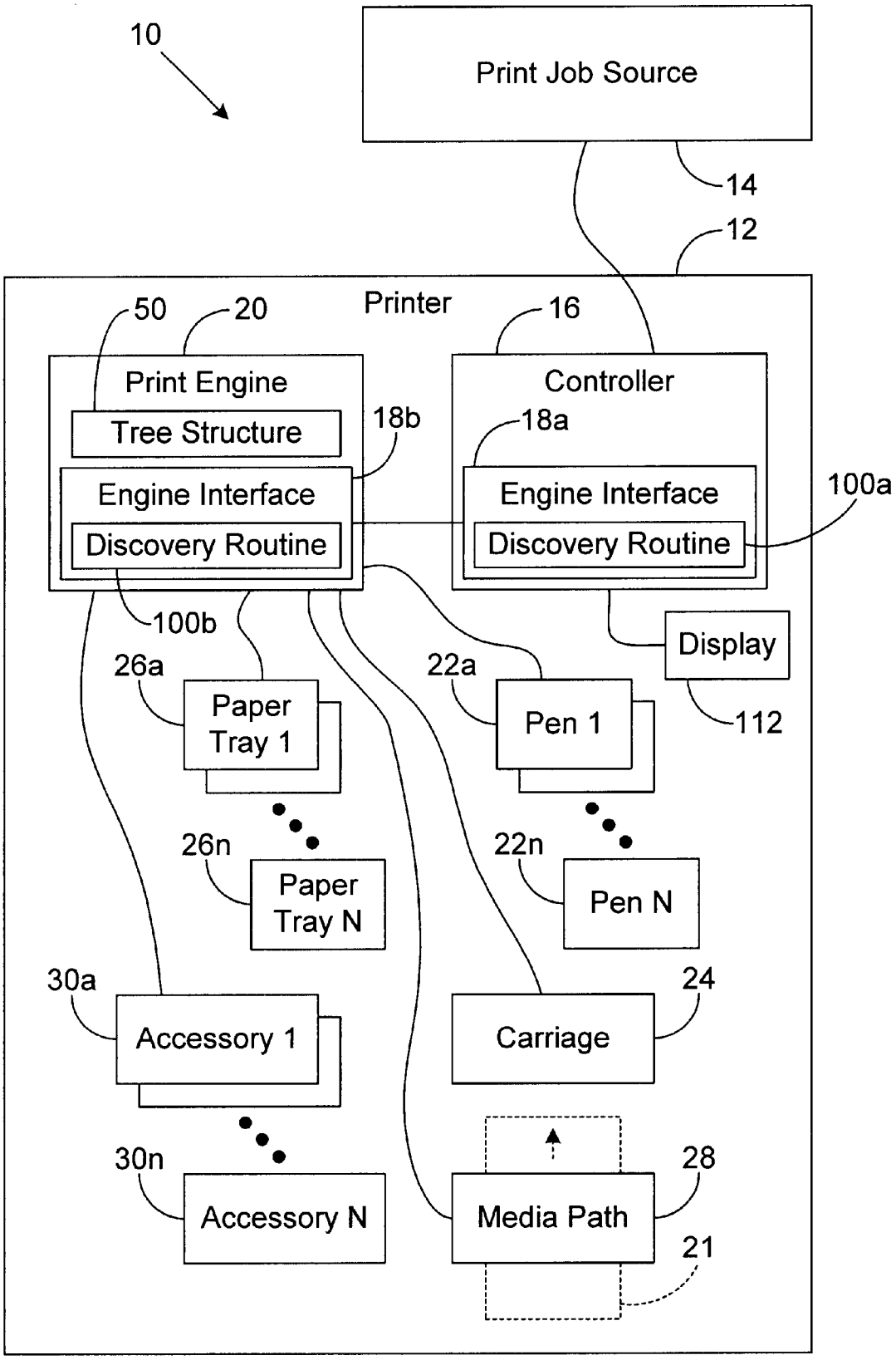
FIG. 1 is a block diagram of a printer system according to the present invention.

In the description that follows, identical components have been given the same reference numerals, regardless of whether they are shown in different embodiments of the present invention.

Referring initially to FIG. 1, a printer system 10 is illustrated. The illustrated printer system 10 includes an inkjet printer 12 coupled to receive a print job from a print job source 14. The print job can be in a format compatible with a printer, such as a page description language (PDL) file or a page control language (PCL) file.

As one skilled in the art will appreciate, the illustrated inkjet printer 12 is exemplary and the present invention applies to inkjet printers having different configurations and to other types of printers including, for example, laser printers, plotters, thermal printers, and the like.

The print job source 14 can be, for example, a computer, a personal digital assistant (PDA), a network server, or the like. The printer 12 can be connected directly to the print job source 14 or coupled to the print job source 14 via a network.

The printer 12 includes a controller 16 for communicating with the print job source 14 and receiving any print jobs transmitted to the printer 12 by the print job source 14. The controller 16 communicates print jobs received from the print job source 14 to a print engine 20 using an engine interface 18. A portion of the engine interface 18*a* forms a part of the controller 16 and a corresponding portion of the engine interface 18*b* forms a part of the print engine 20. The controller 16 may reformat the print job, such as in the form of a raster image, before transmitting all or sequential portions of the print job to the print engine 20. It is noted that the controller 16 can be decoupled from the printer 12 and, in such an embodiment, can be a part of the print job source 14 or other network device, such as a server.

The print engine 20 is responsible for sending command signals to various hardware components of the printer 12 to carry out the task of printing on a print medium 21. The hardware components of the printer 12 will vary depending on the type of printer. For example, in the illustrated inkjet printer 12, pens 22*a*–22*n* are used to deposit ink in the desired pattern on the print medium 21. The pens 22*a*–22*n* can be incorporated into one or more print cartridges that include a printhead with inkjet nozzles for depositing droplets of ink on the print medium. The pens 22*a*–22*n* and associated print cartridge are mounted on a carriage 24 for moving the pens 22*a*–22*n* over the print medium 21. Accordingly, the printer 12 is also provided with mechanical actuators to invoke movement of the carriage 24. However, if the printer 12 is a laser printer, the printer 12 will use, for example, a laser to electrostatically charge a drum to selectively adhere toner to the drum. The toner adhered to the drum is then transferred and fused to the print medium 21.

The printer 12 receives sheets of printable material (the print medium 21) from one of a number of paper trays 24*a*–24*n*. Alternatively, the printer 12 may receive the print medium 21 from a roll of sheet material, a continuous strip of folded material, labels releasably secured to a backing material, envelopes, manually feed items and the like. To advance the printable material, or print medium 21, through the printer 12, a media path 28 is provided. The media path 28 is defined by various mechanical actuators and rollers adapted to advance the print medium 21 as is known in the art. The media path 28 can also include items such as a duplexer, mechanisms to load and/or eject the print medium 21, and the like.

The printer 12 may also include various accessories 30*a*–30*n* and other items used in a printing process or in a print finishing process. Such accessories 30 include, for example, a stapler, various user control buttons or switches, and so forth.

Each of the items of hardware contained within the printer 12 can be monitored for their operational status. For example, sensors can be used to detect whether a pen 22*a*–22*n* is malfunctioning or is out of ink. Sensors can also be used to detect a paper jam, a problem in moving the carriage 24, the presence or absence of a paper tray, a lack of print medium 21, and so forth.

Figure 2:
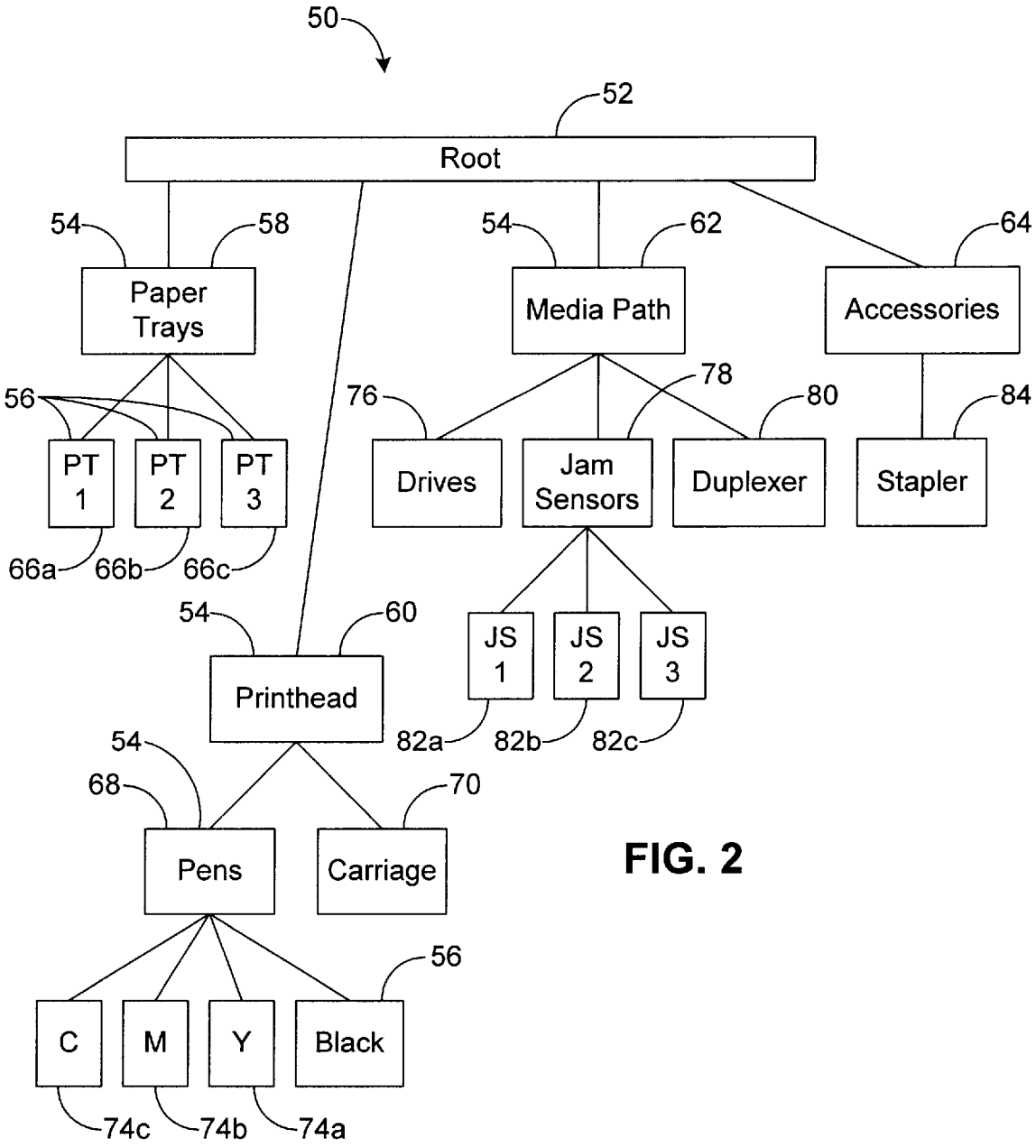
FIG. 2 is a tree structure representing status objects of the printer system of FIG. 1.

With additional reference to FIG. 2, the print engine 12 has a tree structure 50 (also referred to herein as a status structure) used to represent operational condition, or status, of the hardware components of the printer 12. It is noted that the tree structure 50 is exemplary and can take on a number of different configurations as desired by the designer of the printer engine 20 or as appropriate for the specific printer 12.

The tree structure 50 is a hierarchical graph representing operational condition of the hardware contained within the printer 12. The tree structure 50 begins at a root 52 and branches out in a predictable way to nodes 54 that represent groupings of hardware devices. From the nodes 54 the tree structure 50 continues to branch to lower level nodes 54 and/or leaves 56. The leaves 56 represent the lowest level of the tree structure 50 and often represent a single item of hardware or sensor, but can represent a group of hardware items or sensors.

The tree structure 50 is stored in the print engine 20 (FIG. 1) as part of, for example, firmware. The root 52 and each node 54 and leaf 56 of the tree structure 50 has a name and is a programmable object having a data value selected from a plurality of data values (that is, the objects can be embodied as typed data values). More specifically, when the printer 12 is operating normally, the root 52 and each leaf 56 and/or node 54 can have a typed data value indicating that the root 52, the leaves 56 and nodes 54 are operational. However, if the hardware item(s) or sensor(s) represented by the leaf 56 and/or node 54 detects an error or condition affecting the ability of the printer 12 to print, the associated typed data for the status object will change to indicate the error, such as, for example, an "active" designation. The root 52, the nodes 54 and the leaves 56 are also referred to herein a status objects.

An active status designation for a status object indicates that the printer component or supply item (e.g., pen 22*a*–22*n* or print medium 21) associated with the status object is in need of servicing by a user. The active status for a status object is also considered in the art as a condition where the status object is requesting intervention. If any particular status object requests intervention, the print engine 20 will enter an intervention state, possibly suspend a print operation and signal the controller. As will be described in more detail below, the controller 16 and print engine 20 will exchange data signals via the engine interface 18 so that the controller 16 can provide the user with meaningful information regarding the condition of the printer 12 to assist the user in correcting the problem.

In the exemplary tree structure 50 of FIG. 2, there are four nodes 54 positioned at a level immediately below the root 52. These nodes include a paper tray node 58, a printhead node 60, a media path node 62, and an accessories node 64. Three exemplary leaves 66*a*, 66*b* and 66*c* representing three paper trays (PT1, PT2 and PT3, respectively) branch from the paper tray node 58. Branching from the printhead node 60 is a pens node 68 and a carriage node 70. The carriage node 70 can also be considered a leaf 56 as it is the lowest level node for its particular branch of the tree structure 50. The carriage node 70 represents the carriage which moves the pens 22*a*–22*n* (FIG. 1) of a printhead over the print medium 21 (FIG. 1) when the printer 12 is printing. Leaves 56 branching from the pens node 68 include a black pen leaf 72 and colored pen leaves 74*a*, 74*b* and 74*c* for printing in color such as, for example, a cyan (C) pen, magenta (M) pen and yellow (Y) pen, respectively. Branching from the media path node 62 are nodes corresponding to drives used to load, advance and eject the print media (a drives node 76), sensors for detecting print media jams (a jam sensors node 78) and a node representing a duplexer (a duplexer node 80). Branching from the jam sensors node 78 are leaves 82*a*, 82*b*, and 82*c*, representing three jam sensors (JS1, JS2 and JS3, respectively) of the printer 12. Branching from the accessories node 64 is a stapler leaf 84 for representing a stapler device of the printer 12. Each of the foregoing nodes 52 and leaves 56 are example status objects of the tree structure 50.

As indicated above, the tree structure 50 can vary depending on the implementation desired by the designer or upon the particular printer 12. For example, in a laser printer the printhead node 60 and subsequent branches could be replaced by a node and/or branches directed to a laser assembly and toner cartridge.

The controller 16 is programmed to communicate with the print engine 20 via the engine interface 18 to acquire information regarding the status of the printer 12 as represented in the tree structure 50. In addition, the present invention allows the controller 16 to discover information about the organization of the tree structure 50 and the status objects contained therein without prior knowledge of the tree structure 50 or the names of the status objects. It is noted that the root 52 can be known to the controller 16 in advance of the controller 16 communicating with the print engine 20. Alternatively, a name of the root 52 (or root name) can be transmitted to the controller 16 upon entry into an intervention state or in response to a query from the controller 16. Information relating to the tree structure 50 and status objects is valuable in producing meaningful output signals from the controller 16 to indicate to a user that servicing (or an intervention) of the printer 12 may be needed and the nature of the service needed. Alternatively, the information can be used by the controller 16 to enter an appropriate intervention algorithm, such as a self-test of the printer 12, a hardware and/or software reset, etc. The discovery process is based on text queries sent from the controller 16 via the engine interface 18 to the printer 20. In this regard, the engine interface 18 can be viewed as a physical connection between the controller 16 and the print engine 20 as well as programming contained within the controller 16 and/or the print engine 20 to carry out communications between the controller 16 and the print engine 20.

It is conceived that the controller 16 can be installed in a printer 12 without having prior knowledge of the tree structure 50 stored by the print engine 20. The present invention allows the controller 16 to discover the organization of the tree structure 50 and the status objects as normal operation of the printer 12 is interrupted by events that would reduce the capabilities of the printer 12 or render the printer 12 at least temporarily inoperable. As indicated above, these conditions could include, for example, a print media jam, a damaged pen, a pen that has run out of ink, a paper tray that is not installed properly, a lack of print media, a low toner level, etc.

Figure 3:
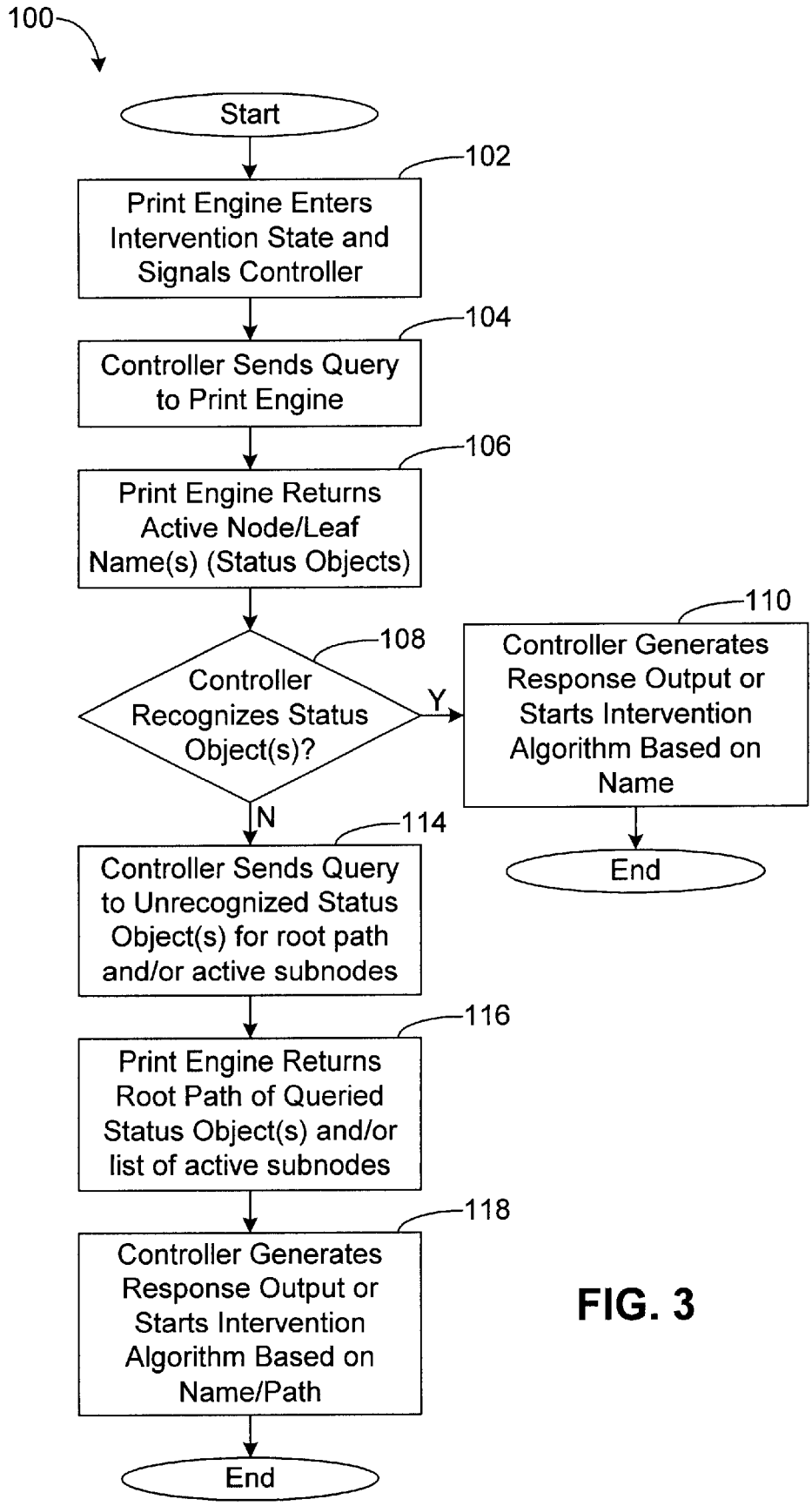
FIG. 3 is a flow chart of a status object discovery routine employed in the printer system of FIG. 1.

With additional reference to FIG. 3, shown is a flowchart of the operation of a status object discovery routine 100 according to an embodiment of the present invention. The discovery routine 100 is a component of the engine interface 18 and a portion of the discovery routine 100 can be a part of the controller 16 (discovery routine 100*a*) and a corresponding portion of the discovery routine can be a part of the print engine 20 (discovery routine 100*b*). Alternatively, the flowchart of FIG. 3 can be viewed as depicting steps of a method implemented in the printer 12. Logic to carry out the discovery routine 100 can be embodied in software code executed by a processor portion or portions of the controller 16 and/or print engine 20, embodied in firmware programmed into the controller 16 and/or the print engine 20, embodied in dedicated hardware or some combination thereof. Accordingly, the discovery routine 100 can be embodied as a status tree discoverer. As one skilled in the art will appreciate, the flowchart of FIG. 3 is exemplary and alternative descriptions and illustrations of the discovery routine 100 falling within the scope of the claims appended hereto can be made.

The discovery routine 100 starts in box 102 where the print engine 20 enters an intervention state. The intervention state is entered into when any of the status objects of the tree structure 50 indicates an active data value as a result of the detection of a problem or condition in printer 12 hardware. For example, if the yellow pen runs out of ink, the status object for the yellow pen leaf 74*c*(FIG. 2) will change data values. The change in data value will be passed through the tree structure 50 via the pen node 68 and printhead node 60 to the root 52. Each of these nodes 54 and the root 52 may also change data values to have an active state. In another example, a malfunction of one of the pens may cause the pens node 68 to change to an active state, indicating to the print engine 20 that an intervention by a user is needed. Upon entering the intervention state, the print engine 20 transmits a signal to the controller 16 that the printer 12 is in the intervention state (box 102). The intervention state signal may contain the root name of the tree structure 50 having the active status object.

Thereafter, in box 104, the controller 16 sends a query to the print engine 20 in response to the intervention state signal received from the print engine 20. The query sent by the controller 16 in box 104 is a "text" query of the root 52 of the tree structure 50. More specifically, the query sent by the controller 16 in box 104 is a request for a list of the names of any active status objects (i.e., the names of the active leaves 56 and/or nodes 54 of the tree structure 50).

In response to the query transmitted by the controller 16 in box 104, the print engine 20, in box 106, will return a list of active status object names to the controller 16. The list may contain the active leaf or leaves, the root name and any intermediate node(s) between the root and the active leaf or leaves. It is noted that in an alternative embodiment, the print engine 20 can be configured to forego transmitting the intervention state signal in box 102 and simply transmit the names of the active status objects as found in box 106 or transmit a combination thereof.

The discovery routine 100 then proceeds to box 108 where the controller 16 determines whether the status object, or status objects, returned by the print engine 20 are recognized names for items of hardware or sensors contained with the printer 12. A name for a status object is recognized if the controller 16 has a meaning associated with the name. For example, the name may have previously programmed into the controller 16, or was previously discovered by prior execution of the discovery routine 100 where the name was mapped to an associated intervention algorithm and such "meaning" was stored in a definition table. A status object name could be, for example, black pen, jam sensor 1, paper tray 1 empty, and so forth.

If, in box 108, the controller 16 recognizes the returned status object name, the controller 16, in box 110, generates an appropriate response output signal based on the recognized name. For example, if the recognized status object name is paper tray 2 missing, then the controller can generate an output signal informing the user to load the missing paper tray in the printer 12. Accordingly, the output signal can be directed to a display 112 (FIG. 1) disposed locally on the printer 12 invoking the display 112 to show an appropriate message or can be sent back to the print job source 14 or other network device for display on, for example, a monitor. Alternatively, the controller 16 can be programmed to enter an intervention algorithm appropriate for the recognized status object name, such as, for example, a self-test routine, a reset, etc. For this purpose, the controller 16 can be programmed with a variety of response output signals and to select an appropriate response output signal based on data received from the print engine 20.

If in box 108, the controller 16 does not recognize a status object name, or names, returned by the print engine 20, the controller 16, in box 114, generates and transmits a query to the unrecognized status objects. More specifically, the controller 16 prepares a "text" query of the node 54 or leaf 56 associated with the status object name(s) returned by the print engine 20 in box 106. For example, if in box 106 the print engine 20 returned a status object name of "jam sensors" (relating to the jam sensors node 78) and this name was not recognized by the controller 16, then in box 114 the controller 16 sends a query to the unrecognized status object of "jam sensors". The query requests the unrecognized status object to return the queried status object's root path.

Thereafter, in box 116, in response to the query of box 114, the print engine 20 returns an identification of the branches from the root to the queried status object. Using the example of "jam sensors" as the unrecognized status object name, upon receipt of the query from box 114, the print engine 20 returns the tree structure 50 paths leading from the jam sensors node 78 to the root 52. In this example, the root path would be from the root 52 to the media path node 62 to the jam sensors node 78.

Upon receiving the root path of the unknown status object name, the controller 16 parses, compares and/or maps the information returned from the print engine 20 (root path and/or status object name) against known values, words, printer terminology and the like to generate a response output for display to the user in box 118. In one embodiment, the controller 16 can be programmed to derive an appropriate output from status object names and/or their root paths. For example, the controller 16 can be provided with a definition table to match against status object names and/or information contained in the root path. In the above example for "jam sensors", the status object name and the root path contain information regarding the handling of print media allowing the controller 16 to generate an output to the user indicating a problem with the handling of the print media such as, for example, an error code or a text message.

To implement the discovery routine 100, the print engine 20 portion of the engine interface 18*b* supports the foregoing text queries of the tree structure 50. Accordingly, queries can be made of the root 52 for each active status object and queries can be made of each status object contained within the tree structure 50. Such queries allow the controller 16 to discovery the underlying root paths for any active node 54 or leaf 56 of the tree structure 50. This information may be valuable in generating a meaningful output to a user even though the status object name associated with an active node 54 or leaf 56 is not known to the controller 16. Over time, the discovery routine 100 can be used by the controller 16 to discover more and more of the tree structure 50 so that most or all of the status object names returned by the print engine 20 in box 106 are eventually recognized by the controller 16 or mapped to recognized names.

Also, in box 114, the controller 16 can generate and send a query to any selected node 54 of the tree structure 50 to request that the selected node 54 return a list of all underlying nodes 54 or leaves 56 that have an active status value (i.e., a list of subnodes that are requesting intervention). Using this additional data, the controller 16 can further piece together the relationship among status objects of the tree structure 50.

As indicated above and depending on the type of status object, the queries generated in box 114 can be a "collection" that request the queried status object to return downward looking information (a list of active subnodes) or upward looking information (the status object's root path).

The discovery routine 100 is programmed to assemble all information gained from the data returned by the print engine 20 in boxes 106 and 116 to place meaning with each status object name. With each use of the discovery routine 100, the controller 16 has an opportunity to gain more and more information about the tree structure 50 so that each status object name can be associated with more specific information allowing the controller 16 to generate messages to the user indicating a recommended intervention action to be taken or to enter an appropriate intervention algorithm.

The discovery routine 100 allows designers of printers 12 to fabricate components, such as the controller 16, having forward compatibility with other printer 12 components, such as the print engine 20. That is, a single controller could be designed for use with any of a number of print engines, each engine having a different tree structure 50 or with print engines not yet developed. The discovery method 100 described herein allows for programming of the controller 16 to generate meaningful intervention messages for display to the user that are in response to status object names returned from the print engine, regardless of the status object's position in the hierarchy of the tree structure associated with the print engine.

In addition, print engine implementers are given greater flexibility in restructuring status tree structure hierarchies in existing printers or in future printers for use with the same controller. For example, in the tree structure 50 of FIG. 2, node 58 refers to paper trays and subsequent leaves 66*a*, 66*b* and 66*c* refer to paper trays 1, 2 and 3. This portion of the tree structure 50 could be used to indistinguishably indicate that a paper tray is missing or that the paper tray is out of print media by changing the data value of an appropriate paper tray leaf 66*a*, 66*b* or 66*c* to have an active state. However, in a future software release, this tree structure 50 can be expanded to have additional nodes and/or leaves to distinguish between a missing paper tray and an empty paper tray. Using the discovery routine 100, corresponding changes to the controller 16 would not be needed since any unrecognized new status object names returned to the controller 16 after the software upgrade to the print engine 20 has been installed would be queried and mapped to a recognized name or meaning. In an alternative example, the contents of a subtree can be expanded within the tree structure 50. Using the example tree structure 50 illustrated in FIG. 2, one could add leaves 56 under the drives node 76 to, for example, isolate one of multiple sensors that may be repeatedly causing the drives node 76 to have an active state. In this example, the meaning of the drives node 76 status object may not have changed, but its contents have been restructured and/or expanded to provide additional lower level information contributed by the new lower level status objects. Such information could be useful to, for example, a repair technician. In another embodiment, the controller 16 can be programmed to save logs of all unrecognized names of status objects. The log can be later viewed by a technician for interpretation and use in diagnosing a problem with the printer 12.

The discovery routine 100 described herein allows for expanding a word length of a status object. More specifically, subtree information could be appended to the name. Effectively, lengthening of the word (or data) is akin to adding new nodes below the name (or address of the status object). Mapped meaning associated with the newly added subtree name(s) could be discovered by the controller 16 using the discovery routine 100. In addition, obsolete status object names contained in a tree structure 50 can be removed while minimizing impact to operation of the controller 16. In previous controller 16 designs, the controller 16 was programmed to depend on prior knowledge of the tree structure 50 to traverse the tree structure 50. Therefore, any obsolete intermediate nodes 54 of the tree structure 50 would have to be left in place for any particular leaf 56 to remain reachable by the controller 16.

Printer designers who use the controller 16 of the present invention need only to understand the general discovery method used by the controller 16 and not the underlying tree structure 50 of the printer's print engine 20. Therefore, documentation of the tree structure 50 of the print engine 20 may not need to be as rigorous as previous documentation requirements.

Testing of a controller's 16 interaction with a print engine 20 also may become simpler when using the discovery routine 100 of the present invention. For example, emphasis can be placed on verifying that the appropriate intervention message or algorithm is selected for an active status object rather than verifying correct traversal of the tree structure 50.

In sum, the present invention results in fewer compatibility restrictions between the controller 16 and the print engine 20.

Although the logic used to carry out the discovery routine 100 of the present invention in the illustrated embodiment can be embodied in programmed hardware components of the controller 16 and/or in programmed hardware components of the print engine 20, the logic can be embodied in software or code executed by a general purpose processor or can be embodied in dedicated hardware or a combination of software and hardware. If embodied in dedicated hardware, the logic can be implemented as a circuit or a state machine that employs any one of or a combination of a number of techniques. These technologies can include, but are not limited to, discrete logic circuits having logic gates for implementing various logic functions upon an action of one or more data signals, applications specific integrated circuits having appropriate logic states, programmable gate arrays (PGA), field programmable gate arrays (FPGA), or other components. Such technologies are generally well known by those skilled in the art and, consequently, are not described in detail herein.

The figures show the architecture, functionality and operation of an implementation of the printer 12 and of the discovery routine 100. If embodied in software, each illustrated block of the discovery routine 100 may represent a module, segment or portion of code that comprises program instructions to implement the specified logical function(s). The program instructions may be embodied in a form of source code that comprises human-readable statements written in a programming language or machine code that comprises instructions recognizable by a suitable execution system, such as a processor. The machine code may be converted from the source code. If embodied in hardware, each block may represent a circuit or a number of interconnected circuits to implement the specified logical function (s).

Although the discovery routine 100 illustrates a specific order of execution, it is understood that the order of execution may differ from that which is depicted. For example, the order of execution of two or more blocks may be changed relative to the order shown. Also, two or more blocks shown in succession may be executed concurrently or with partial concurrence. In addition, any number of counters, state variables, warning semaphores, or messages might be added to the logical flow described herein, for purposes of enhanced utility, accounting, performance, measurement, or providing trouble shooting aids, and the like. It is understood that all such variations are within the scope of the present invention.

Where the discovery routine 100 comprises software or code, the discovery routine 100 can be embodied in any computer-readable medium for use by or in connection with an instruction execution system such as, for example, a processor, or for subsequent "burning" into a programmable device. In this sense, the logic may comprise, for example, statements including instructions or declarations that can be fetched in the form of computer-readable medium and executed by the instruction logic system. In the context of the present invention, a "computer-readable medium" can be any medium that can obtain, store or maintain the logic described herein for use by or in connection with the instruction execution system. A computer-readable medium can comprise any one of any physical media such as, for example, electronic, magnetic, optical, electromagnetic or semiconductor media. More specific examples of suitable computer-readable medium include, but are not limited to, magnetic tapes, magnetic floppy diskettes, magnetic hard drives, or compact disks. Also, the computer-readable medium can be random access memory (RAM). Alternatively, the computer-readable medium can be read-only memory (ROM), programmable read-only memory (PROM), erasable programmable read-only memory (EPROM), electronically erasable programmable read-only memory (EEPROM), or other type of memory device.

Although particular embodiments of the invention have been described in detail, it is understood that the invention is not limited correspondingly in scope, but includes all changes, modifications and equivalents coming within the spirit and terms of the claims appended hereto.

For example, portions of the discovery routine 100 can be repeated to yield additional information about the tree structure 50 so that the controller 16 can produce a meaningful response output or enter into an appropriate intervention algorithm. For example, box 114 could be repeated to query an unrecognized status object name that was returned in box 116 or to query a different node of the tree structure 50 than was originally queried in box 114.

What is claimed is:

1. A method of determining an arrangement of status objects forming a status tree structure used to represent hardware components contained within a printer and the status tree structure stored within a print engine of the printer, comprising:

detecting a change in operational condition of one of the hardware components with a sensor;

changing a state of a status object corresponding to the one of the hardware components to have an active state, thereby indicating an intervention state of the printer;

transmitting a name of the status object having the changed state from the print engine to a controller, the name of the status object being unrecognized by the controller; and querying the status object having the changed state and unrecognized name for a root path of the status object with the controller.

2. The method according to claim 1, wherein the name of the status object is transmitted by the print engine in response to a query by the controller following a receipt of an intervention state signal transmitted from the print engine to the controller.

3. The method according to claim 1, further comprising maintaining a log of unrecognized status object names received by the controller.

4. The method according to claim 1, further comprising querying a node of the status tree structure for a list of names of any status objects having an active state and branching from the queried node.

5. The method according to claim 4, wherein the queried node is a root node.

6. The method according to claim 1, further comprising associating a meaning with the name of the status object.

7. The method according to claim 1, further comprising generating and outputting a response output signal from the controller, the response output used to indicate an intervention action to a user.

8. The method according to claim 1, further comprising establishing a representation of relationships among status objects contained in the tree structure using status object name and root path data received from the print engine.

9. A printer system, comprising:

a controller that communicates with a print job source and receiving a print job from the print job source;

a print engine that controls hardware components of a printer to place a desired image on a print medium in response to print data received from the controller;

a status tree structure stored by the print engine and having an arrangement of status objects used to represent the hardware components of the printer; and a status tree discoverer adapted to determine an arrangement of the status objects by querying a status object having a name unrecognized by the controller for a root path of the status object, the query transmitted upon receipt of the name from the print engine, the name transmitted from the print engine to the controller when a state of the status object changes to an active state in response to a change in operational condition of the hardware component associated with the status object and thereby indicating an intervention state of the printer.

10. The printer system according to claim 9, wherein the name of the status object is transmitted by the print engine in response to a query by the controller following a receipt of an intervention state signal transmitted from the print engine to the controller.

11. The printer system according to claim 9, wherein the status tree discoverer queries a node of the status tree structure for a list of names of any status objects having an active state and branching from the queried node.

12. The printer system according to claim 11, wherein the queried node is a root node.

13. The printer system according to claim 9, wherein the status tree discoverer associates a meaning with the name of the status object.

14. The printer system according to claim 9, wherein the controller is adapted to generate and output a response output signal used to indicate an intervention action to a user on a display.

15. The printer system according to claim 9, wherein the status tree discoverer establishes a representation of relationships among status objects contained in the tree structure using status object name and root path data received from the print engine.

16. The printer system according to claim 9, wherein the controller maintains a log of unrecognized status object names.

17. A controller for a printer, comprising:

means to receive a print job from a print job source and transmit corresponding print data to a print engine of a printer; and means to determine an arrangement of status objects forming a status tree structure used to represent hardware components contained within the printer and the status tree structure stored within the print engine, the determining means including:

means to receive a name of an active status object from the print engine, the active status object indicating an intervention state of the printer due to a change in operational condition of a hardware component of the printer; and means to query the active status object when the name of the active status object is unrecognized by the controller for a root path of the active status object.

18. The controller according to claim 17, wherein the name of the status object is received from the print engine as part of a response to a query sent from the controller to the print engine following a receipt of an intervention state signal from the print engine.

19. The controller according to claim 17, wherein the controller maintains a log of unrecognized status object names.

20. The controller according to claim 17, wherein the determining means further includes means to query a node of the status tree structure for a list of names of any status objects having an active state and branching from the queried node.

21. The controller according to claim 20, wherein the queried node is a root node.

22. The controller according to claim 17, wherein the determining means further includes means to associate a meaning with the name of the status object.

23. The controller according to claim 17, further comprising means to generate and output a response output signal to indicate an intervention action to a user.

24. The controller according to claim 17, wherein the determining means further includes means to establish a representation of relationships among status objects contained in the tree structure using status object name and root path data received from the print engine.

* * * * *